US009173531B2

(12) United States Patent
Chiu et al.

(10) Patent No.: US 9,173,531 B2
(45) Date of Patent: Nov. 3, 2015

(54) DUAL-PURPOSE VACUUM CLEANER

(71) Applicant: EGENPOWER INC., Laguna Niguel, CA (US)

(72) Inventors: Ting-Yin Chiu, Taichung (TW); Gary Li, Dong Guan (CN)

(73) Assignee: EGENPOWER INC., Laguna Niguel, CA (US)

( * ) Notice: Subject to any disclaimer, the term of this patent is extended or adjusted under 35 U.S.C. 154(b) by 448 days.

(21) Appl. No.: 13/861,048

(22) Filed: Apr. 11, 2013

(65) Prior Publication Data

US 2013/0269148 A1 Oct. 17, 2013

(30) Foreign Application Priority Data

Apr. 12, 2012 (CN) ..... 2012 1 0112728

(51) Int. Cl.

| | |
|---|---|
| ***A47L 9/28*** | (2006.01) |
| ***A47L 5/22*** | (2006.01) |
| ***A47L 5/24*** | (2006.01) |
| ***A47L 9/00*** | (2006.01) |
| ***A47L 9/24*** | (2006.01) |

(52) U.S. Cl.

CPC . *A47L 5/225* (2013.01); *A47L 5/24* (2013.01); *A47L 9/00* (2013.01); *A47L 9/009* (2013.01); *A47L 9/24* (2013.01); *A47L 9/2868* (2013.01); *A47L 2201/00* (2013.01)

(58) Field of Classification Search

CPC ..... A47L 5/225; A47L 9/24; A47L 9/2868; A47L 9/009; A47L 9/00; A47L 5/24; A47L 2201/00

USPC ..... 15/328, 329, 331, DIG. 1, 319, 339, 15/340.1

IPC ..... A47L 9/28

See application file for complete search history.

(56) References Cited

U.S. PATENT DOCUMENTS

| | | | | |
|---|---|---|---|---|
| 5,709,007 | A * | 1/1998 | Chiang | A47L 5/225 15/329 |
| 6,882,201 | B1 | 4/2005 | Koch, II et al. | |
| 2007/0157416 | A1* | 7/2007 | Lee | A47L 5/362 15/319 |
| 2007/0157420 | A1* | 7/2007 | Lee | A47L 5/225 15/328 |
| 2012/0189507 | A1* | 7/2012 | Ko | A47L 5/225 422/291 |

* cited by examiner

*Primary Examiner* — David Redding

(74) *Attorney, Agent, or Firm* — Muncy, Geissler, Olds & Lowe, P.C.

(57) ABSTRACT

A dual-purpose vacuum cleaner includes a self-walking carriage including three or more wheels, an accommodation chamber providing at least one bearing face, a roller brush, a dust guide, a passageway connected to the accommodation chamber and a plurality of first contacts disposed in the accommodation chamber, a hand-held vacuum cleaner detachably accommodated in the accommodation chamber and including at least one abutment face, a handle, a dust suction entrance attached to the passageway and a plurality of second contacts respectively physically kept in contact with the first contacts, and a cover covered on the self-walking carriage to conceal the hand-held vacuum cleaner in the self-walking carriage.

9 Claims, 7 Drawing Sheets

DUAL-PURPOSE VACUUM CLEANER

BACKGROUND OF THE INVENTION

1. Field of the Invention

The present invention relates to vacuum cleaners and more particularly, to a self-walking vacuum cleaner, which provides a self-walking mode and a hand-held mode for option.

2. Description of the Related Art

A conventional self-walking vacuum cleaner generally comprises a dust suction mechanism mounted in a self-walking device (or self-walking robot). It can automatically walk and do a dust suction work during walking.

U.S. Pat. No. 6,882,201 discloses a floor-cleaning robot, which uses a roller brush assembly for sweeping dust particles. The roller brush assembly includes two roller brushes arranged in parallel. Relative rotation between these two roller brushes can drive dust particles out of the floor, enabling a vacuum device to suck in lifted dust particles into a storage bag.

However, conventional self-walking vacuum cleaners simply provide one single function, i.e., it can simply walk on the floor. If the user temporarily wishes to clean a particular local area, for example, tabletop, dust accumulated area or floor mat where a self-walking vacuum cleaner is not approachable, the user needs to use a hand-held vacuum cleaner or to employ other cleaning measures to remove dust. This practice is not very economical, but also a lot of trouble.

SUMMARY OF THE INVENTION

The present invention has been accomplished under the circumstances in view. It is the main object of the present invention to provide a dual-purpose vacuum cleaner, which provides a self-walking operating function and a hand-held operating function for doing a vacuum cleaning either in a self-walking condition or hand-held condition.

To achieve this and other objects of the present invention, a dual-purpose vacuum cleaner in accordance with the present invention comprises a self-walking carriage, a hand-held vacuum cleaner, and a cover. The self-walking carriage comprises at least three wheels pivotally mounted at the bottom side thereof and rotatable on the floor, a top-opened accommodation chamber defining therein at least one bearing face, a roller brush rotatably mounted at the bottom side thereof and disposed at a front side relative to the accommodation chamber, a dust guide located at the bottom side thereof and disposed at a rear side relative to the roller brush and having its front side disposed in contact with the floor and its rear side extending backwardly upwards, a passageway having its one end connected to the rear side of the dust guide and its other end connected to the top-opened accommodation chamber, and a plurality of first contacts disposed in the top-opened accommodation chamber. The self-walking carriage has mounted therein a first power source, a first controller and a first driver. The first controller is electrically connected to the first power source and the first contacts. The first driver is electrically connected to the first controller and coupled with at least one wheel of the at least three wheels, and controllable by the first controller to rotate the at least one wheel of the at least three wheels forward or backward. The hand-held vacuum cleaner is detachably accommodated in the top-opened accommodation chamber, s comprising at least one abutment face for abutting against the at least one bearing face of the self-walking carriage, a handle, a dust suction entrance located at the front side thereof and attachable to the passageway, and a plurality of second contacts for physically contacting the first contacts respectively. Further, the hand-held vacuum cleaner has mounted therein a second power source, a second controller and a second driver. The second controller is electrically connected to the second power source and the second contacts. The second driver is electrically connected to the second controller and selectively controllable by the first controller or the second controller to start a vacuum cleaning function. The cover is detachably covered on the self-walking carriage to conceal the hand-held vacuum cleaner in the self-walking carriage.

Thus, the dual-purpose vacuum cleaner provides a self-walking operating function and a hand-held operating function for doing a vacuum cleaning either in a self-walking condition or hand-held condition.

Preferably, the cover is opaque.

Preferably, the number of the at least one bearing face in the top-opened accommodation chamber is 2, and the two bearing faces are respectively disposed in opposite front and rear sides in the top-opened accommodation chamber; the number of the at least one abutment face of the hand-held vacuum cleaner is 2, and the two abutment faces are respectively disposed at opposing front and rear sides of the hand-held vacuum cleaner.

Further, the passageway has its one end extended to the bearing face at the front side in the top-opened accommodation chamber; the dust suction entrance of the hand-held vacuum cleaner is located at the abutment face at the front side of the hand-held vacuum cleaner.

Preferably, the first contacts are disposed at the bearing face at the rear side in the top-opened accommodation chamber; the second contacts are disposed at the abutment face at the rear side of the hand-held vacuum cleaner.

Preferably, the first contacts are retractable spring-loaded pins that contract when compressed and have an appropriate elastic restoring force.

Preferably, the first driver and the second driver are motors.

The self-walking/hand-held dual-purpose vacuum cleaner further comprises a third driver electrically connected to the first controller and controllable by the first controller to rotate the roller brush.

Preferably, the self-walking carriage has a car-shaped configuration.

Other advantages and features of the present invention will be fully understood by reference to the following specification in conjunction with the accompanying drawings, in which like reference signs denote like components of structure.

DETAILED DESCRIPTION OF THE INVENTION

Figure 1:
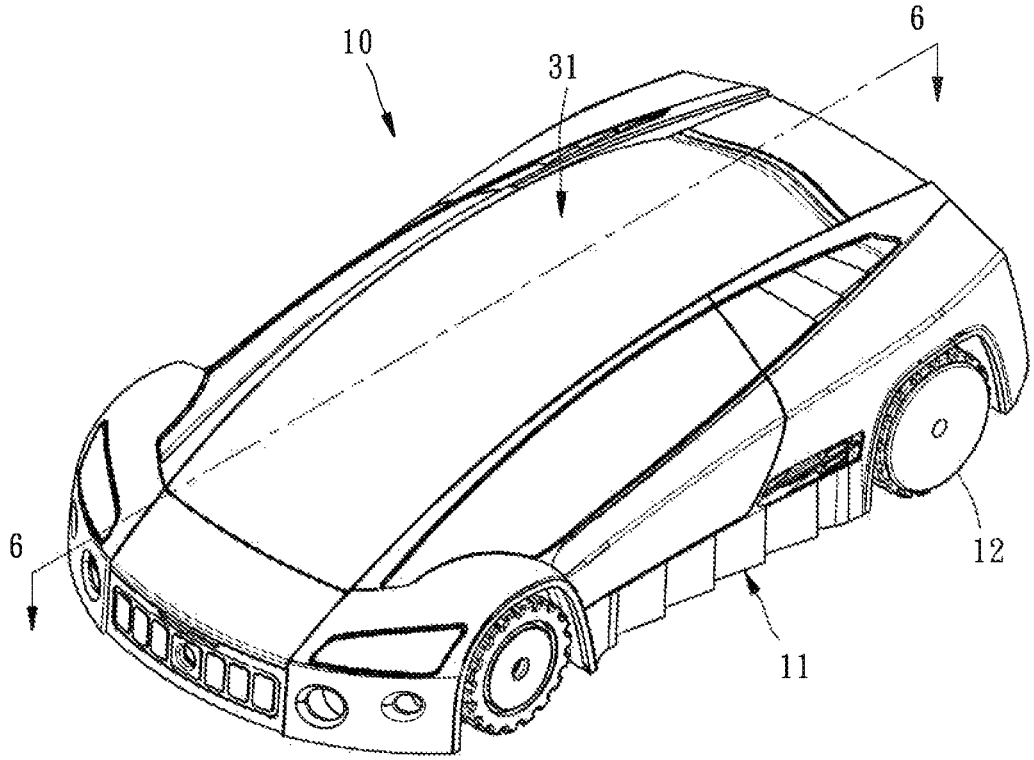
FIG. 1 is an oblique top elevational view of a dual-purpose vacuum cleaner in accordance with the present invention.

Referring to FIGS. 1-7, a self-walking dual-purpose vacuum cleaner 10 in accordance with the present invention is shown. The self-walking dual-purpose vacuum cleaner 10 comprises a self-walking carriage 11, a hand-held vacuum cleaner 21, and a cover 31.

The self-walking carriage 11 comprises at least three wheels 12 pivotally mounted at the bottom side thereof and rotatable on the floor. The self-walking carriage 11 further comprises a top-opened accommodation chamber 13, a roller brush 14, a dust guide 15, a passageway 16, and a plurality of first contacts 18.

At least one bearing face 131 is extended from the self-walking carriage 11 into the inside of the top-opened accommodation chamber 13. The roller brush 14 is rotatably mounted at the bottom side of the self-walking carriage 11 and disposed at a front side relative to the accommodation chamber 13. The dust guide 15 is mounted at the bottom side of the self-walking carriage 11 and disposed at a rear side relative to the roller brush 14. Further, the dust guide 15 has its front side kept in contact with the floor, and its rear side backwardly upwardly extended to one end of the passageway 16. The opposite end of the passageway 16 is kept in communication with the accommodation chamber 13. The first contacts 18 are disposed in the accommodation chamber 13.

According to the present preferred embodiment, there are two bearing faces 131 respectively disposed at opposing front and rear sides inside the top-opened accommodation chamber 13. The passageway 16 has its one end extended from the front-sided bearing face 131. The first contacts 18 are located at the rear-sided bearing face 131. Further, these first contacts 18 are retractable spring-loaded pins that contract when compressed and have an appropriate elastic restoring force.

The self-walking carriage 11 comprises a first power source 111, a first controller 112, and a first driver 113. The first controller 112 is electrically connected to the first power source 111 and the first contact 18. The first driver 113 is electrically connected to the first controller 112, actually connected to at least one wheel 12 of the at least three wheels 12. The first controller 112 controls the at least one wheel 12 of the at least three wheels 12 to rotate forwards or backwards. According to the present preferred embodiment, the number of the at least three wheels 12 is 3, however, in actual application, having heels is not a limitation, for example, the number of the at least three wheels 12 can be 4. Further, according to the present preferred embodiment, the self-walking carriage is shaped like a car, however, in actual application, this car-shaped configuration is not a limitation, for example, it can be made having a disk-shaped or oval-shaped configuration.

The hand-held vacuum cleaner 21 comprises at least one abutment face 22, a handle 24, a dust suction entrance 26, and a plurality of second contacts 28. The dust suction entrance 26 is located at the front side of the hand-held vacuum cleaner 21. The hand-held vacuum cleaner 21 is detachably accommodated in the accommodation chamber 13 with the at least one abutment face 22 thereof abutted against the at least one bearing face 131 of the self-walking carriage 11. Further, the second contacts 28 are respectively physically kept in contact with the first contacts 18. Further, the dust suction entrance 26 is attached to the passageway 16.

According to the present preferred embodiment, the number of the at least one abutment face 22 of the hand-held vacuum cleaner 21 is 2, and these two abutment faces 22 are respectively located at the opposing front and rear sides of the hand-held vacuum cleaner 21. The dust suction entrance 26 of the hand-held vacuum cleaner 21 is located at the front-sided abutment face 22. The second contacts 28 are located at the rear-sided abutment face 22. Further, these second contacts 28 are metal plate members.

The hand-held vacuum cleaner 21 comprises a second power source 211, a second controller 212, and a second driver 213. The second controller 212 is electrically connected to the second power source 211 and the second contacts 28. The second driver 213 is electrically connected to the second controller 212, and controlled by the first controller 112 or the second controller 212 to drive a fan blade 29 in the hand-held vacuum cleaner 21 to create suction for driving dirt and other contaminates into the dust guide 15.

The cover 31 is covered on the self-walking carriage 11 to conceal the hand-held vacuum cleaner 21 in the self-walking carriage 11. Further, in the present preferred embodiment, the cover 31 is opaque.

In the present preferred embodiment, the first driver 113 and the second driver 213 are electrical motors. Further, the roller brush 14 is rotatable by a third driver 114. The third driver 114 is electrically connected to the first controller 112, and controllable by the first controller 112.

Figure 7:
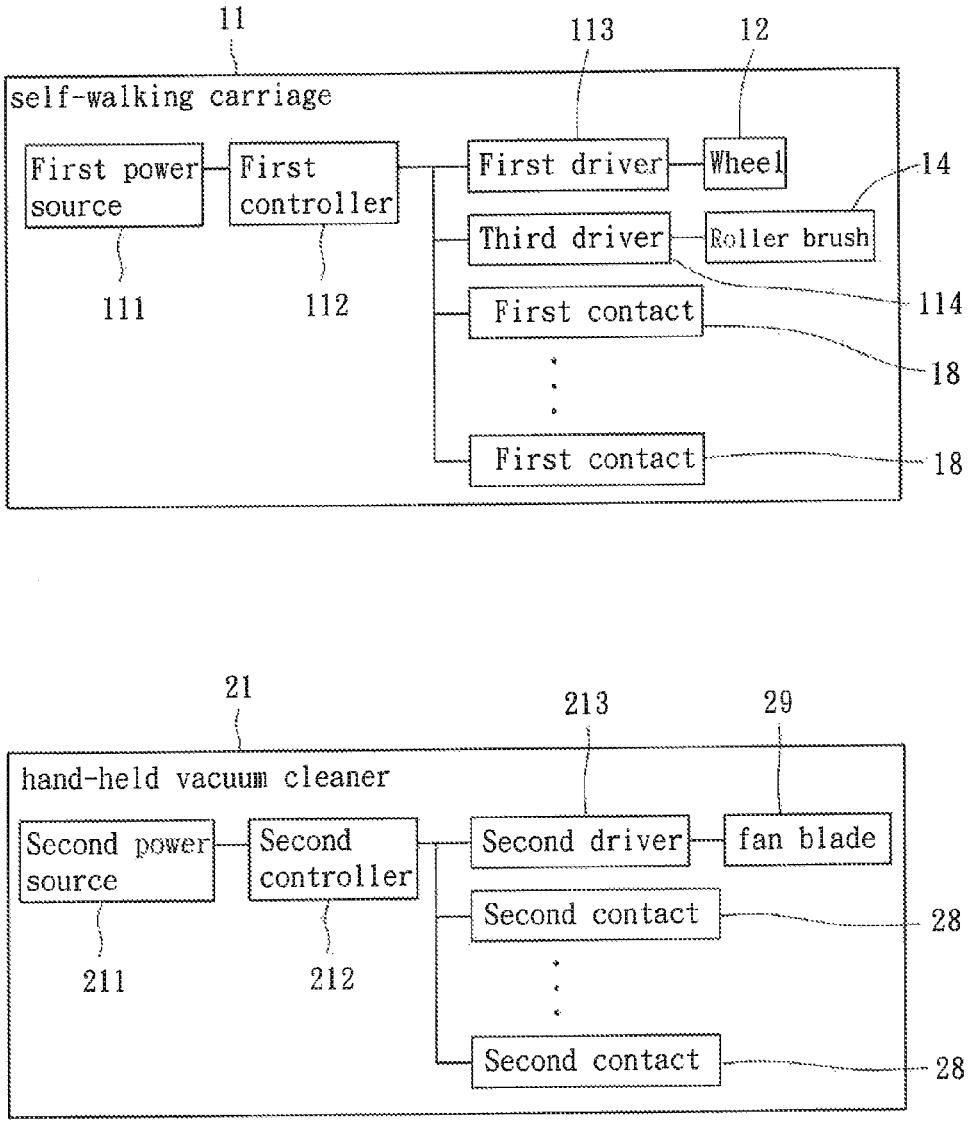
FIG. 7 is a circuit block diagram of the dual-purpose vacuum cleaner in accordance with the present invention.

Further, in the present preferred embodiment, the first power source and the second power source are batteries; the first controller and the second controller are conventional microprocessors. Because these components are of the known art and not within the scope of the technical features of the present invention, their circuit configuration is shown in FIG. 7.

After understanding of the construction and composition of the present invention, the operation of the self-walking dual-purpose vacuum cleaner is outlined hereinafter.

The self-walking dual-purpose vacuum cleaner 10 provides a self-walking operation mode and a hand-held operation mode.

Referring to FIGS. 1-7, when using the self-walking dual-purpose vacuum cleaner 10 in the self-walking operation mode, open the cover 31, and then put the hand-held vacuum cleaner 21 in the accommodation chamber 13 and then cover the cover 31 on the self-walking carriage 11 and place the self-walking dual-purpose vacuum cleaner 10 on the floor. When putting the hand-held vacuum cleaner 21 in the accommodation chamber 13, the abutment faces 22 of the hand-held vacuum cleaner 21 will be respectively abutted against the bearing face 131 of the accommodation chamber 13. Further, the second contact 28 are respectively and physically kept in contact with the respective first contacts 18 to electrically connect the first controller 112 and the second controller 212, and the connection status between the first controller 112 and the second controller 212 can be known subject to electrical functioning. In the present preferred embodiment, the first contacts 18 are retractable spring-loaded pins that contract when compressed and have an appropriate elastic restoring force. Further, the first contacts 18 is surrounded by a cladding material, thus, the rear-sided abutment face 22 of the hand-held vacuum cleaner 21 is supported by the wrapping material of the first contacts 18, i.e., indirectly stopped against the rear-sided bearing face 131 in the accommodation chamber 13. At this time, the user can give a command to the first controller 112 or the second controller 212 by means of, for example, a remote controller or control button, to start a vacuum cleaning function. Using a remote controller or control button to start up a vacuum cleaner is the known technique, and therefore no further detailed description in this regard will be necessary.

After startup of the vacuum cleaning function, the first controller 112 controls the first driver 113 one or two of the three wheels 12, moving the self-walking carriage 11 forward or backward. The first controller 112 also controls the third driver 114 to rotate the roller brush 14, driving dirt and other contaminates into the dust guide 15. At the same time, the second driver 213 will be controlled by the first controller 112 or the second controller 212 to rotate the fan blade 29, thereby sucking in dust and contaminants from the dust guide 15. During movement of the self-walking carriage 11 at this time, the necessary working power supply for the cleaner is provided by the first power source 111. However, when using the hand-held vacuum cleaner 21 to such in dust and contaminants, the necessary working power supply is provided by the second power source 211.

Figure 2:
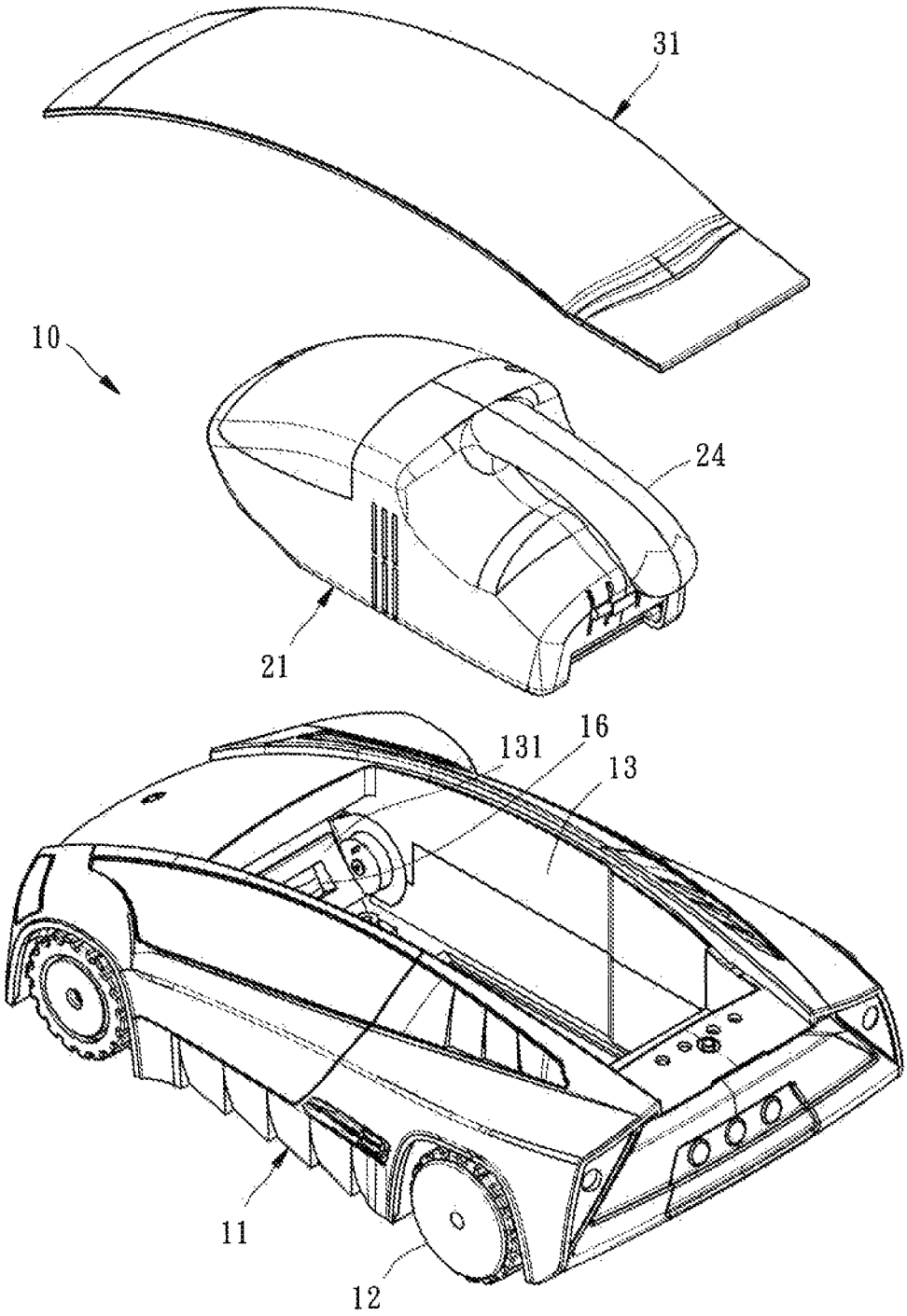
FIG. 2 is an oblique top exploded view e dual-purpose vacuum cleaner in accordance with the present invention.
Figure 3:
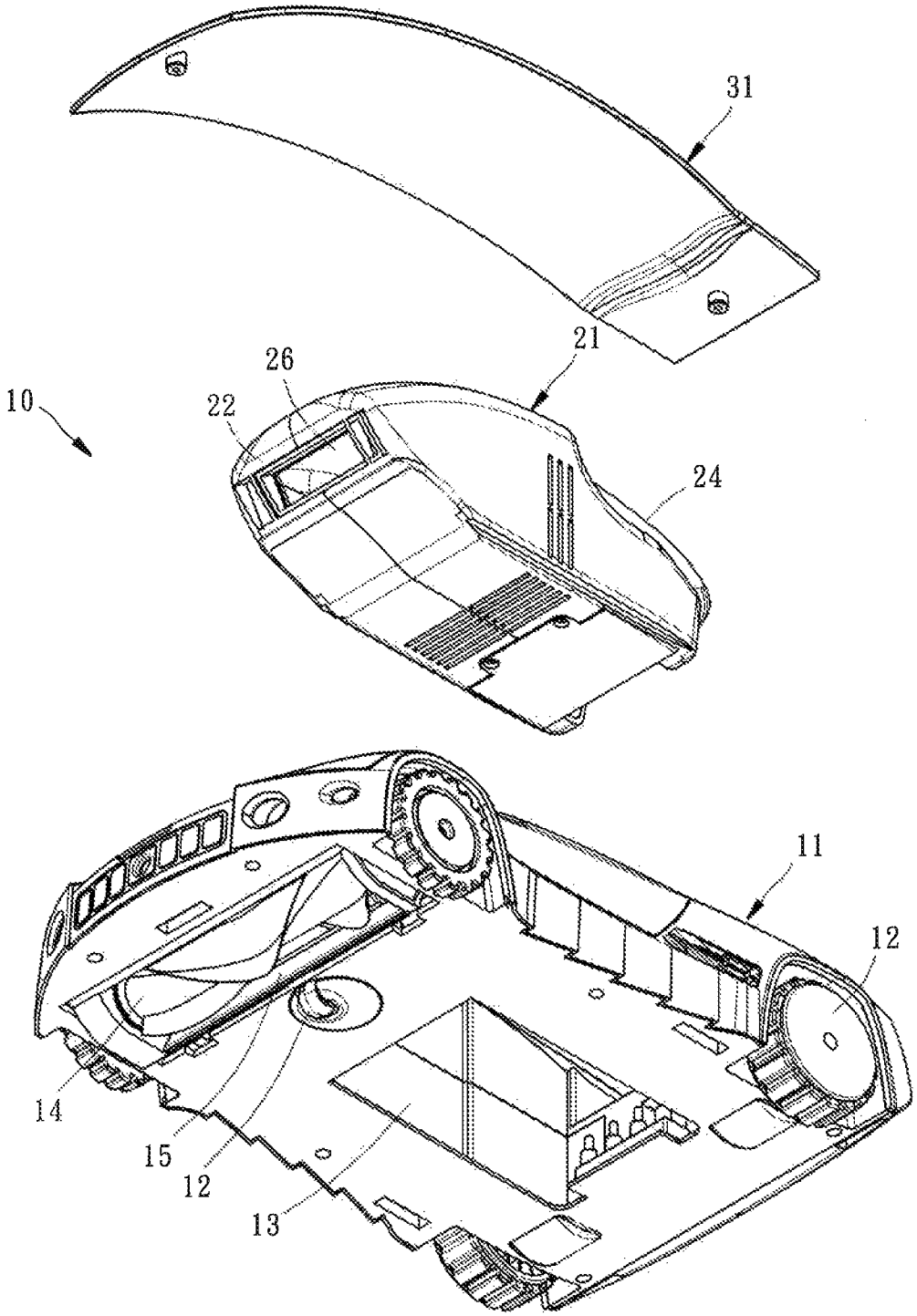
FIG. 3 is an oblique bottom exploded view of the dual-purpose vacuum cleaner in accordance with the present invention.
Figure 4:
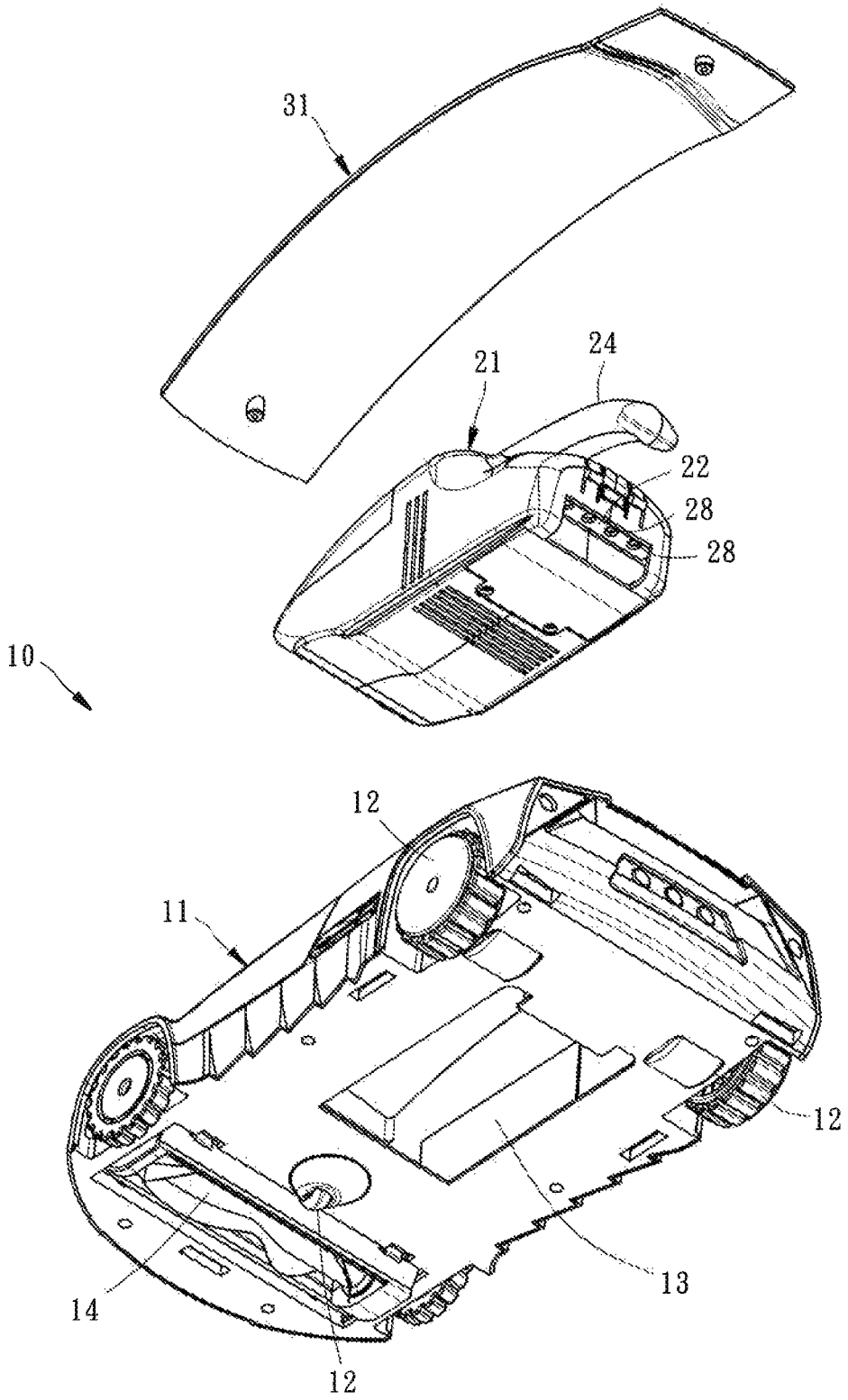
FIG. 4 corresponds to FIG. 3 when viewed from another angle.
Figure 5:
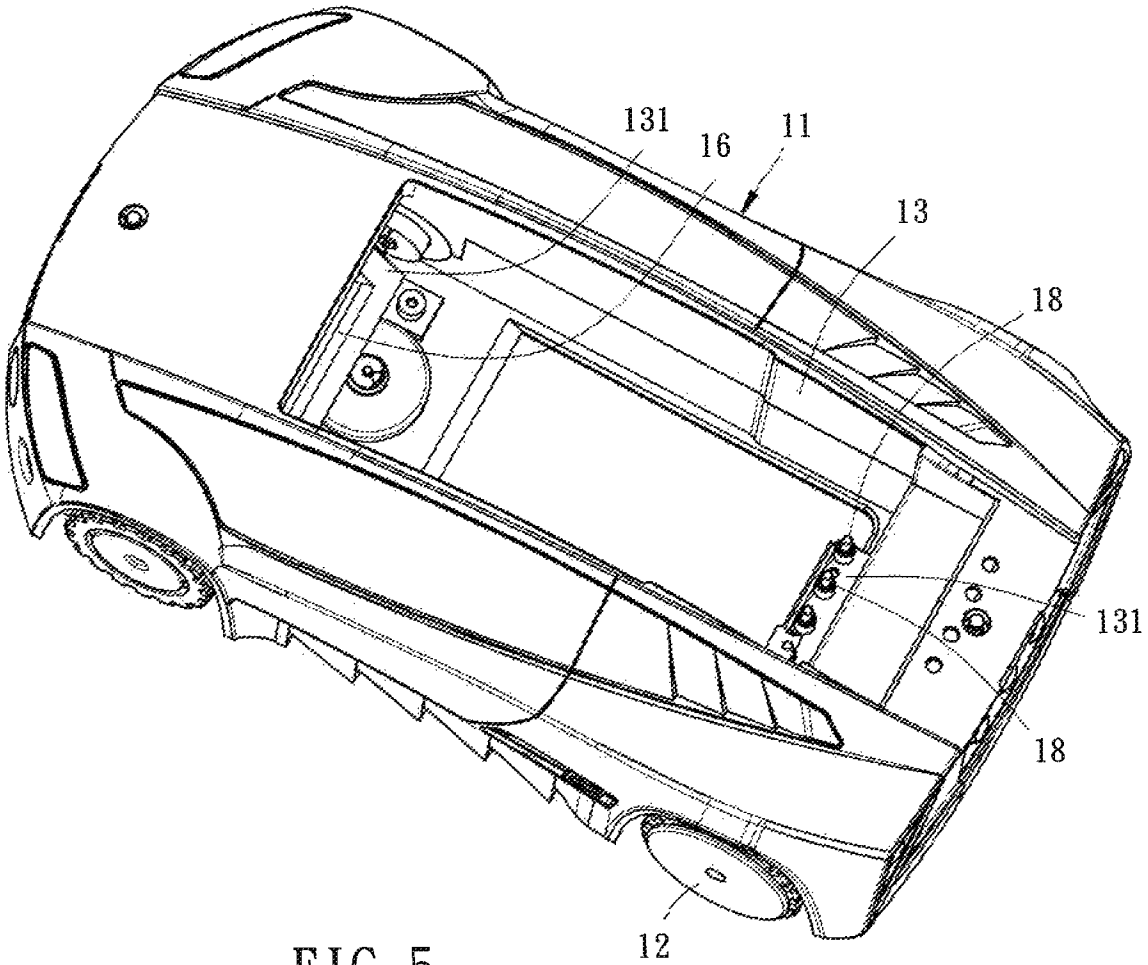
FIG. 5 is an oblique top view of a part of the present invention, illustrating the structure of the self-walking carriage of the dual-purpose vacuum cleaner.
Figure 6:
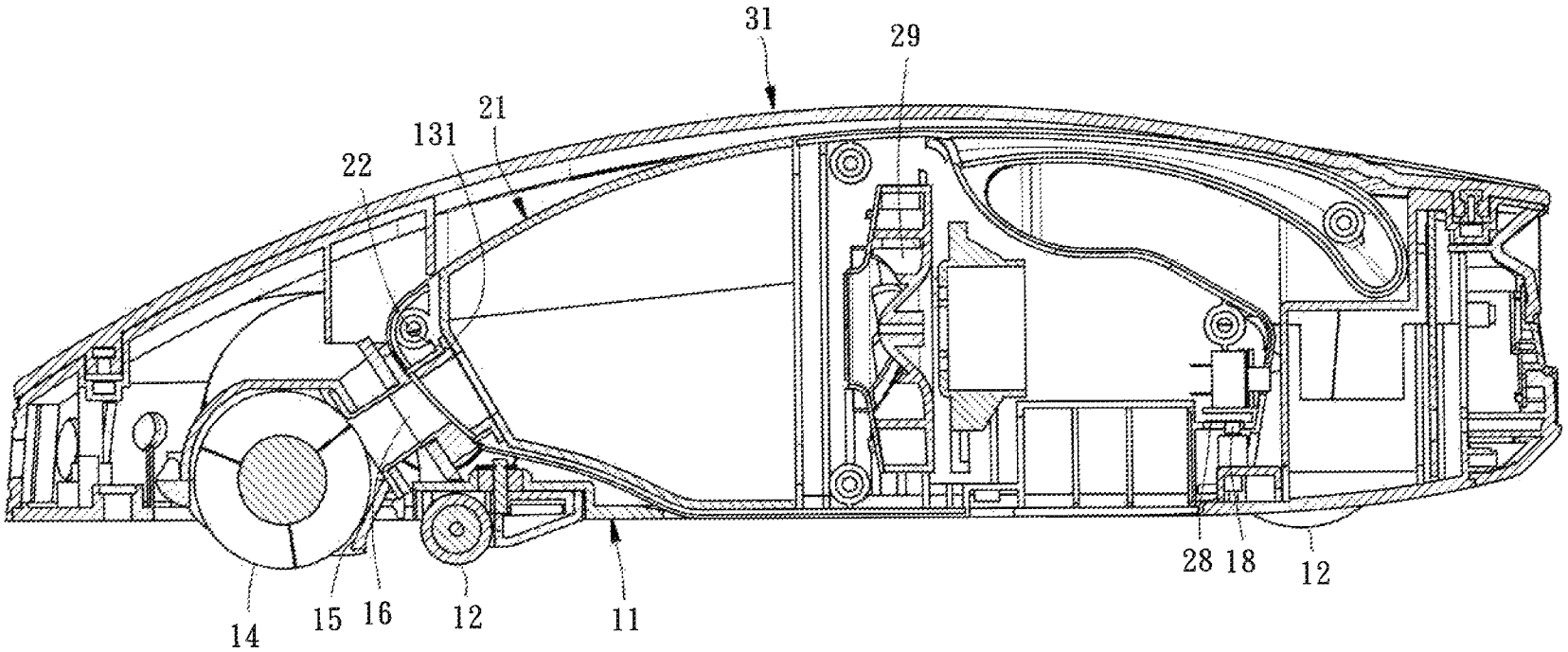
FIG. 6 is a sectional view taken along line 6-6 of FIG. 1.

Referring to FIG. 2, when the hand-held operation mode is selected, open the cover 31, and then pick up the hand-held vacuum cleaner 21. At this time, the user can give a command to the second controller 212 by means of a remote controller or control button, and then move the hand-held vacuum cleaner 21 to approach the dust suction entrance 26 to the area to be cleaned, achieving the desired dust suction effect.

As stated above, the invention is practically operable between the self-walking mode and the hand-held mode, achieving the desired self-walking and hand-held dual-purpose vacuum cleaning effects.

It is to be understood that the number of the at least one bearing face in the accommodation chamber 13 can be 1, and the corresponding at least one abutment face of the hand-held vacuum cleaner 21 can also be 1. Physically, the two bearing faces in the aforesaid preferred embodiment can be connected together, forming one single bearing face; the aforesaid two abutment faces can be extended from the bottom side of the hand-held vacuum cleaner 21 and then combined into one single abutment face. In mechanical design, joining two bearing faces into one single bearing face and two abutment faces into one single abutment face is the known technique, no further detailed description in this regard will be necessary.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dual-purpose vacuum cleaner, comprising:

a self-walking carriage comprising at least three wheels pivotally mounted at a bottom side thereof and rotatable on the floor, a top-opened accommodation chamber defining therein at least one bearing face, a roller brush rotatably mounted at the bottom side of said self-walking carriage and disposed at a front side relative to said accommodation chamber, a dust guide located at the bottom side of said self-walking carriage and disposed at a rear side relative to said roller brush, said dust guide having a front side thereof disposed in contact with the floor and a rear side thereof backwardly upwardly extended from said front side, a passageway having one end thereof connected to the rear side of said dust guide and an opposite end thereof connected to said top-opened accommodation chamber, and a plurality of first contacts disposed in said top-opened accommodation chamber;

a first power source, a first controller and a first driver mounted in said self-walking carriage, said first controller being electrically connected to said first power source and said first contacts, said first driver being electrically connected to said first controller and coupled with at least one wheel of said at least three wheels and controllable by said first controller to rotate said at least one wheel of said at least three wheels forward or backward;

a hand-held vacuum cleaner detachably accommodated in said top-opened accommodation chamber, said hand-held vacuum cleaner comprising at least one abutment face for abutting against said at least one bearing face of said self-walking carriage, a handle, a dust suction entrance located at a front side thereof and attachable to said passageway, and a plurality of second contacts for physically contacting said first contacts respectively;

a second power source, a second controller and a second driver mounted in said hand-held vacuum cleaner, said second controller being electrically connected to said second power source and said second contacts, said second driver being electrically connected to said second controller and selectively controllable by said first controller or said second controller to start a vacuum cleaning function; and a cover detachably covered on said self-walking carriage to conceal said hand-held vacuum cleaner in said self-walking carriage.

2. The self-walking/hand-held dual-purpose vacuum cleaner as claimed in claim 1, wherein said cover is opaque.

3. The self-walking/hand-held dual-purpose vacuum cleaner as claimed in claim 1, wherein the number of said at least one bearing face in said top-opened accommodation chamber is two, and the two said bearing faces are respectively disposed in opposite front and rear sides in said top-opened accommodation chamber; the number of said at least one abutment face of said hand-held vacuum cleaner is two, and the two said abutment faces are respectively disposed at opposing front and rear sides of said hand-held vacuum cleaner.

4. The self-walking/hand-held dual-purpose vacuum cleaner as claimed in claim 3, wherein said passageway has one end thereof extended to the bearing face at the front side in said top-opened accommodation chamber; said dust suction entrance of said hand-held vacuum cleaner is located at the abutment face at the front side of said hand-held vacuum cleaner.

5. The self-walking/hand-held dual-purpose vacuum cleaner as claimed in claim 3, wherein said first contacts are disposed at the bearing face at the rear side in said top-opened accommodation chamber; said second contacts are disposed at the abutment face at the rear side of said hand-held vacuum cleaner.

6. The self-walking/hand-held dual-purpose vacuum cleaner as claimed in claim 1, wherein said first contacts are retractable spring-loaded pins that contract when compressed and have an appropriate elastic restoring force.

7. The self-walking/hand-held dual-purpose vacuum cleaner as claimed in claim 1, wherein said first driver and said second driver are motors.

8. The self-walking/hand-held dual-purpose vacuum cleaner as claimed in claim 1, further comprising a third driver electrically connected to said first controller and controllable by said first controller to rotate said roller brush.

9. The self-walking/hand-held dual-purpose vacuum cleaner as claimed in claim 1, wherein said self-walking carriage has a car-shaped configuration.

* * * * *